US009873589B1

(12) United States Patent
Halker

(10) Patent No.: US 9,873,589 B1
(45) Date of Patent: Jan. 23, 2018

(54) STRING DISPENSING ASSEMBLY FOR USE IN CONNECTION WITH CEILING INSTALLATION

(71) Applicant: Nicholas Halker, Lockport, NY (US)

(72) Inventor: Nicholas Halker, Lockport, NY (US)

( * ) Notice: Subject to any disclaimer, the term of this patent is extended or adjusted under 35 U.S.C. 154(b) by 0 days.

(21) Appl. No.: 15/586,464

(22) Filed: May 4, 2017

(51) Int. Cl.

| | |
|---|---|
| ***E04F 21/00*** | (2006.01) |
| ***E04B 9/00*** | (2006.01) |
| ***B65H 75/44*** | (2006.01) |
| ***B65H 75/10*** | (2006.01) |
| ***B65H 75/32*** | (2006.01) |

(52) U.S. Cl.
CPC ..... *B65H 75/446* (2013.01); *B65H 75/10* (2013.01); *B65H 75/32* (2013.01); *E04B 9/00* (2013.01); *E04F 21/00* (2013.01); *B65H 2701/353* (2013.01)

(58) Field of Classification Search
CPC .... B65H 75/446; E04F 21/00; E04F 21/1877; E04F 21/0076
See application file for complete search history.

(56) References Cited

U.S. PATENT DOCUMENTS 3,066,416 A * 12/1962 Gutting ..... B25B 5/10 33/1 F
3,540,548 A * 11/1970 Halsey ..... E04F 21/1838 182/129
3,767,008 A * 10/1973 LeBlanc ..... E04F 21/1805 182/129
3,775,929 A * 12/1973 Roodvoets ..... E04F 21/1838 33/286
5,177,929 A * 1/1993 Reynolds ..... E04B 9/22 52/506.1
5,519,976 A * 5/1996 Gee ..... E04B 9/18 24/67 AR
5,893,250 A * 4/1999 Benvenuto ..... E04B 9/0478 52/506.06
6,374,504 B1 * 4/2002 Graham ..... E04G 21/1891 33/1 LE
6,725,556 B1 * 4/2004 Graham ..... B25H 7/00 33/429
7,051,446 B2 * 5/2006 Moss ..... B25H 7/00 33/414
7,299,559 B2 * 11/2007 Moss ..... B25H 7/00 33/423

(Continued)

*Primary Examiner* — Rodney Mintz
(74) *Attorney, Agent, or Firm* — Del Vecchio and Stadler LLP

(57) ABSTRACT

A string dispensing assembly is provided comprising a housing having opposed first and second housing ends that define first and second housing openings that lead to a housing interior in which a string supply is stored. A first engagement support member extends outwardly from the housing and has opposed convex and concave sides that extend to an engagement tab. The engagement tab is folded in on itself in such a way that the engagement tab faces the concave side of the first support member. End and feed caps close the second and first openings and a string from the string supply extends through the first housing opening and abuts the housing and feed cap. The engagement tab is adapted to be secured to a main runner folded portion of a first wall angle thus securing the housing, and the string is for aligning and squaring purposes.

8 Claims, 5 Drawing Sheets

(56) References Cited

U.S. PATENT DOCUMENTS 7,409,771 B2 * 8/2008 Bond ..... B65H 75/04 33/1 LE
7,513,054 B2 * 4/2009 Moss ..... B25H 7/00 33/423
7,665,223 B2 * 2/2010 Swanson ..... E04F 21/0076 33/701
7,841,246 B2 * 11/2010 Swanson ..... B65H 61/00 33/756
8,220,167 B2 * 7/2012 Swanson ..... E04F 21/0076 33/1 G
8,418,373 B2 * 4/2013 Swanson ..... G01B 5/004 33/1 G
8,533,966 B2 * 9/2013 Mikhaylenko ..... B44D 3/38 33/414
8,751,193 B2 * 6/2014 Swanson ..... G01B 5/004 33/756
9,408,500 B2 * 8/2016 McFall ..... A47K 3/38
2005/0210805 A1 * 9/2005 Shepard ..... E04B 9/064 52/506.06
2005/0257390 A1 * 11/2005 Moss ..... B25H 7/00 33/429
2005/0285088 A1 * 12/2005 Welker ..... H02G 1/085 254/134.3 FT
2006/0124910 A1 * 6/2006 Welker ..... H02G 1/08 254/134.3 FT
2006/0201009 A1 * 9/2006 Moss ..... B25H 7/00 33/429
2007/0022710 A1 * 2/2007 DeSoto ..... E04B 9/001 52/749.1
2007/0029433 A1 * 2/2007 Bond ..... B65H 75/04 242/400.1
2008/0052938 A1 * 3/2008 Moss ..... B25H 7/00 33/534
2009/0313844 A1 * 12/2009 Swanson ..... E04F 21/0076 33/756
2010/0089175 A1 * 4/2010 Swanson ..... B65H 61/00 73/862.44
2011/0119936 A1 * 5/2011 Swanson ..... E04F 21/0076 33/228
2011/0126416 A1 * 6/2011 Swanson ..... G01B 5/004 33/527
2011/0131008 A1 * 6/2011 Swanson ..... G01B 5/004 702/152
2015/0135426 A1 * 5/2015 McFall ..... A47K 3/38 4/610

* cited by examiner

STRING DISPENSING ASSEMBLY FOR USE IN CONNECTION WITH CEILING INSTALLATION

BACKGROUND

When buildings are constructed the builder uses joists for supporting the floors of the building. The opposed ends of the joists are typically supported on the foundation of the building or on studs. The joists are typically made of wood and support floor boards, that when installed form a floor.

However, the exposed joists are not visually appealing, and exposed joists are not suitable for professional settings, for example offices. Thus to conceal the joists builders install acoustical/drop ceilings (sometimes called hanging ceilings). Drop/acoustical ceilings are complex and difficult to install because the angles and dimensions of the room, for example the internal length and width of the room, and thus careful planning is required prior to installing the drop/acoustical ceiling. In addition, the actual construction of the drop/acoustical ceiling is complex. The drop/acoustical ceilings are made from a plurality of components. For example, the drop/acoustical ceiling requires the installation of main runners that extend from one side of the room to the other side of the room, and in most instances the main runners need to be parallel to one another. The main runners are supported from hanger wires, and the joists support the hanger wires. In addition, the main runners are supported at their ends by wall angles that are connected to the walls of the room. To add structural stability, T-connectors are installed and connect one main runner to another main runner such that the T-connectors are perpendicular to the main runners. The main runners and T-connectors support ceiling tiles.

Workers use string when they are installing drop/acoustical ceilings. The string is situated such that it is close or proximal to the main runner, and the string serves as a reference for the workers. The string is pulled tight by the workers and connected to the wall angles so that the string is at a right angle relative to each of the opposed walls of the room. The workers can then detect if the ceiling is angle relative to each of the opposed walls of the room. The workers can detect if the ceiling is square by visually comparing the main runner to the string line. If the main runner is out of square the workers can then adjust the main runners to the string-line until the strings are parallel with one another. However, the process of installing and moving the string relative to the main runners requires two (2) workers.

What is needed is a device that allows one worker to quickly install, use, and remove the squaring string. The device ought to be easy to use, accurate, and inexpensive to manufacture.

SUMMARY

A string dispensing assembly is provided comprising a housing having a first housing end that defines a first housing opening, and having an opposed second housing end that defines a second housing opening. The first and second housing openings lead to a housing interior, and the housing has opposed interior and exterior housing surfaces.

First and second support members extend outwardly from the exterior surface of the housing along first and second bent portions, and each of the first and second support members has opposed convex and concave surfaces. Each of the first and second support members has an engagement tab. The engagement tabs are formed by folding portions of the first and second support members in on themselves. Thus, an engagement tab faces the concave side of the first support member and an engagement tab faces the concave side of the second support member. In addition, each of the engagement tabs and the concave sides of the first and second support members that they face define an engagement slot. A string supply is positioned in the housing interior and a string can be pulled from the string supply. An end cap is fitted in the second housing opening, and a feed cap is inserted into the first housing opening. The string extends from the string supply and between the feed cap and the interior housing surface such that abuts the feed cap and the interior housing surface. The housing also has a cutting tab for cutting the string.

The engagement tabs are adapted to be fitted on wall angles that are supported on the walls of a room, such that the string dispensing assembly is supported by the wall angles.

In another embodiment the housing only has the first support member and the second support member is absent, and in other embodiments there may be more than two support members.

After the string dispensing assembly is hooked onto the first wall angle, a user can draw string out of the housing and extend it across the room. The user can detect whether or not the main runner is sagging by using the string as a reference, and if the user determines the main runner is not parallel to the sting the user adjusts the wire hangers supporting the main runner until the main runner parallel and string are parallel to one another. After all the main runners are squared in this manner and the ceiling tiles are installed on the main runners there are no portions of the ceiling that are sagging and the ceiling will not sag in the future.

In another embodiment the second housing end has a taper and this eliminates the need for the end cap.

BRIEF DESCRIPTION OF THE DRAWING FIGURES

DESCRIPTION

At the outset it is stated that in the variously described embodiments and/or structures herein, identical parts, surfaces and components are provided with like reference numbers.

Figure 1:
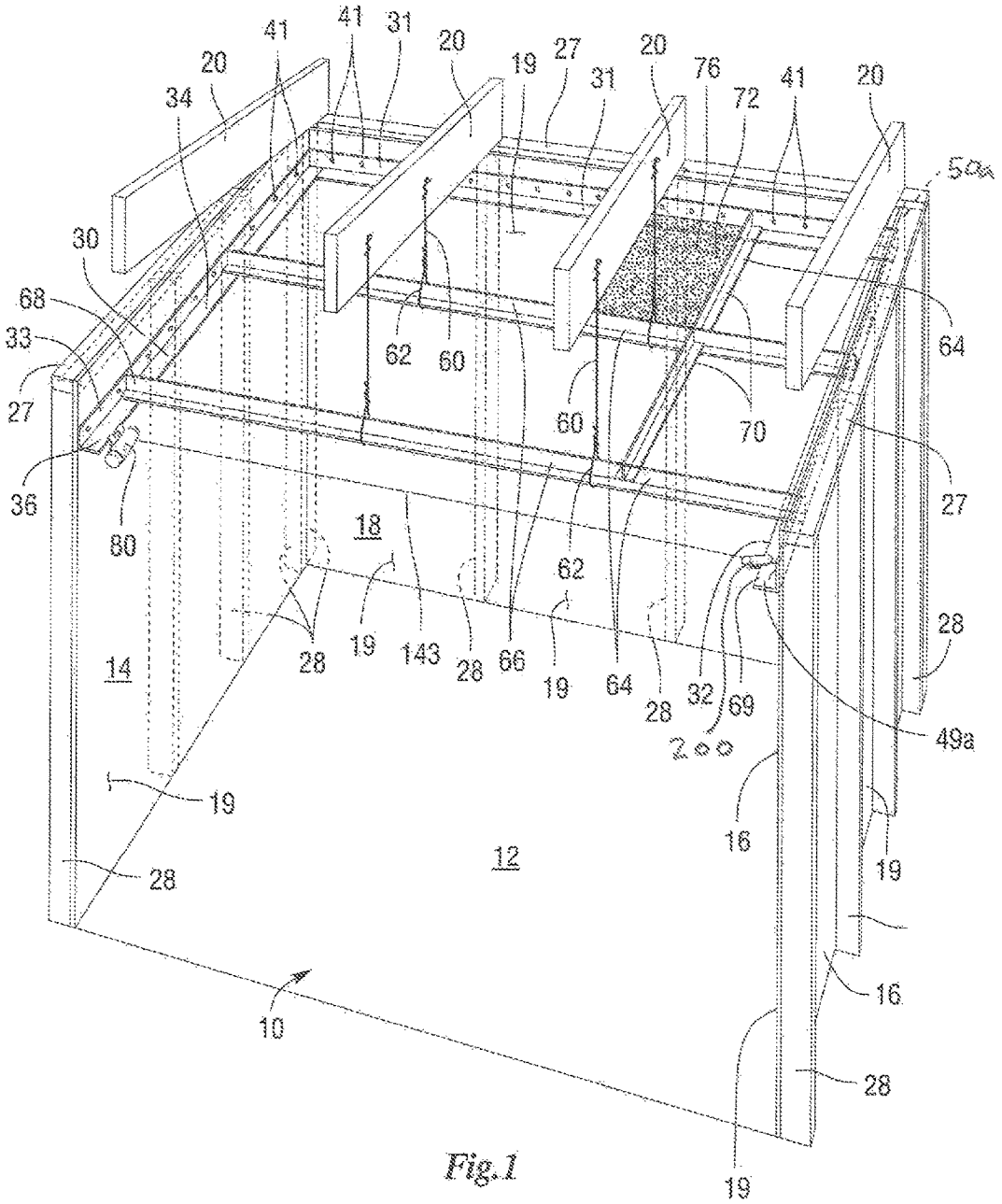
FIG. 1 is a perspective view of a room showing the string dispensing assembly installed on a wall angle.

FIG. 1 shows a portion of a room 10 having a floor 12, opposed first and second side walls 14, 16 that face one another, and a cross wall 18 that extends from the first side wall 14 to the second side wall 16. The first and second sidewalls 14, 16 and cross wall 18 are formed from drywall panels 19 that, in turn, are connected to and supported on studs 28. It is pointed out and it is to be understood that there may be another cross wall (not shown) that faces the cross wall 18, such that room has a generally box-shape. Also shown are the joists 20 used in the construction, and the joists 20 are supported by wall framing 27 and the studs 28.

After the room 10 is built as described above, first and second wall angles 30, 32 are installed on the opposed first and second sidewalls 14, 16, and a third wall angle 31 is installed on the cross wall 18. As indicted in FIGS. 3 and 4, the first, second and third wall angles 30, 32, 31 are supported by fasteners 47 such as screws, bolts or nails that extend though the first, second and third wall angles, through the drywall panels 19 and into the studs 28. It is pointed out that the first and second wall angles 30, 32 have the same length designated L1 (FIG. 2), and the third wall angle 31 may have the same length L1 or may have a length that is greater or less than L1.

Figure 3:
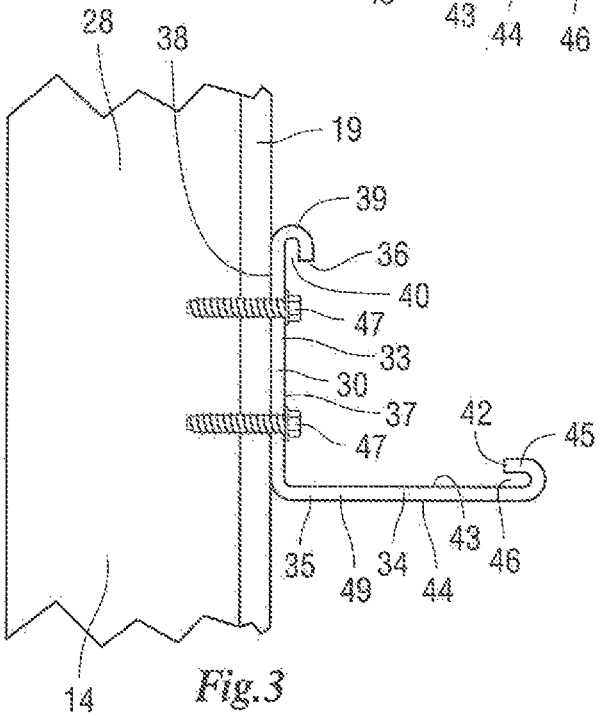
FIG. 3 is side view of the first wall angle.
Figure 4:
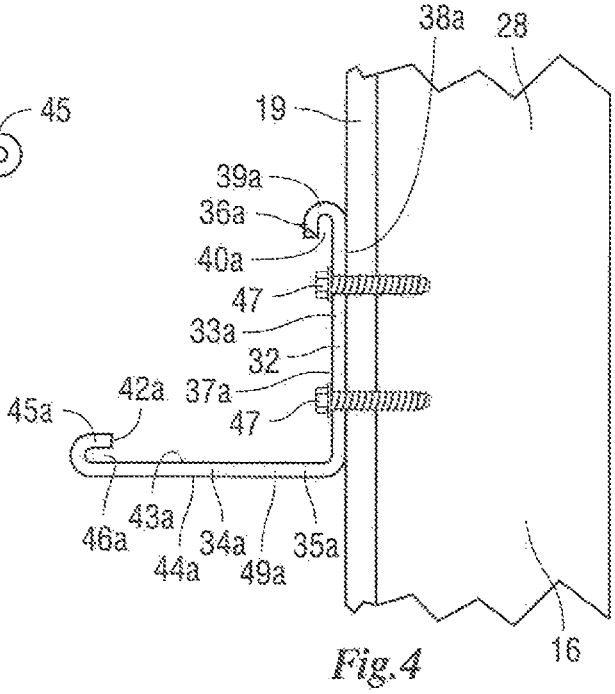
FIG. 4 is a side view of a second wall angle.

The first and second wall angles 30, 32 are structurally identical, with the second wall angle 32 rotated one hundred eighty degrees relative to the first wall angle 30 in FIGS. 3 and 4.

Figure 2:
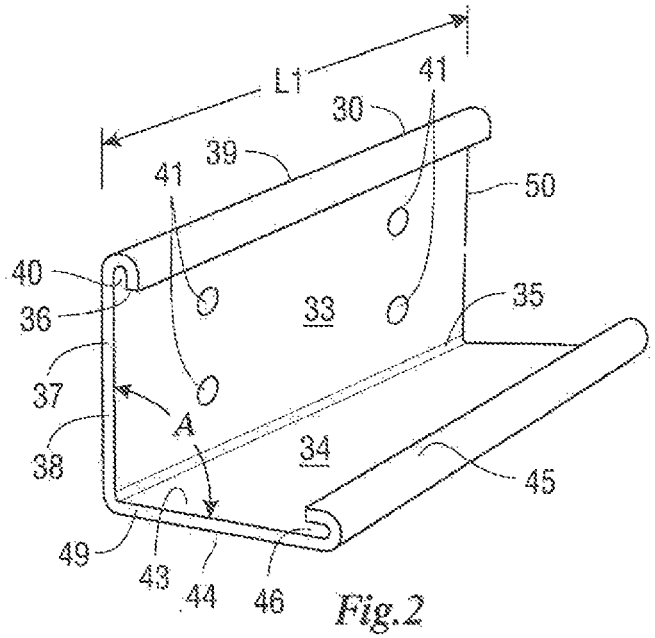
FIG. 2 is a perspective view of a first wall angle.

The first wall angle 30 has a wall mounting portion 33 that is joined to a main runner support portion 34 at a bend 35, such that the wall mounting portion 33 is at or about at a ninety-degree angle to the main runner support portion 34 (as indicated by arrow A in FIG. 2). The first wall angle 30 also has opposed first and second ends 49, 50 (see FIG. 2). The mounting portion 33 has opposed first and second mounting portion surfaces 37, 38, and has a mount folded portion 39. The mount folded portion 39 is bent or folded and extends to a wall mount end 36 that faces the main runner support portion 34, and such that the first mounting portion surface 37 faces itself as shown in FIG. 2. The mount folded portion 39 defines a mount slot 40 that extends along the length L1 the wall mounting portion 33. The wall mounting portion 33 also defines fastener openings 41 (FIG. 2) for receiving the fasteners 47 therein, and the fasteners 47 can be moved through the fastener openings 41 and driven through the drywall panels 19 and into the studs 28. In other embodiments the fastener openings 41 are absent and the fastener 47, such as a nail, is driven through the wall mounting portion 33, through the drywall 19 and into the stud 28.

The main runner support portion 34 has a main runner end 42 and opposed first and second main runner support surfaces 43, 44, and has a main runner folded portion 45. The main runner folded portion 45 is bent or folded such that the main runner end 42 faces the wall mounting portion 33, and such that first main runner support surface 43 faces itself as shown in FIGS. 2 and 3. The main runner folded portion 45 defines a main runner slot 46 that extends along the length L1 of the main runner support portion 34. The first wall angle 30 may be made of metal, plastic and other suitable materials.

As previously mentioned, the second wall angle 32 shown in FIG. 4 is structurally identical to the above described first wall angle 30. The second wall angle 32 has a wall mounting portion 33*a* that is joined to a main runner support portion 34*a* at a bend 35*a*, such that the wall mounting portion 33*a* is at or about at a ninety-degree angle to the main runner support portion 34*a*. The second wall angle 32 also has opposed first and second ends 49*a*, 50*a* (shown in FIG. 1). The wall mounting portion 33*a* has a wall mount end 36*a* and opposed first and second mounting portion surfaces 37*a*, 38*a*, and has a mount folded portion 39*a*. The mount folded portion 39*a* is bent or folded such that the wall mount end 36*a* faces the main runner support portion 34*a*, and such that first mounting portion surface 37*a* faces itself as shown in FIG. 4. The mount folded portion 39*a* defines a mount slot 40*a* that extends along the length L1 the wall mounting portion 33*a*. The wall mounting portion 33*a* also defines fastener openings 41*a* for receiving fasteners 47 therein, and the fasteners 47 can be moved through the fastener openings 41 and driven through the drywall panels 19 and into the studs 28. In other embodiments the fastener openings 41*a* are absent and the fasteners 47, such as a nail, is driven through the wall mounting portion 33*a*, through the drywall 19 and into the stud 28.

The main runner support portion 34*a* has a main runner end 42*a* and opposed first and second main runner support surfaces 43*a*, 44*a*, and has a main runner folded portion 45*a*. The main runner folded portion 45*a* is bent or folded such that the main runner end 42*a* faces the wall mounting portion 33*a*, and such that first main runner support surface 43*a* faces itself as shown in FIG. 4. The main runner folded portion 45*a* defines a main runner slot 46*a* that extends along the length L1 main runner support portion 34*a*. The second wall angle 32 may be made of metal, plastic and other suitable materials.

As shown in FIG. 1 there are also wire hangers 60 that are connected to and suspended from the joists 20 and the wire hangers 60 are spaced apart from one another along the joists 20. The wire hangers 60 have hook-shaped end portions 62.

A ceiling tile support frame 64 is supported from main runners 66. The ceiling tile support frame 64 includes the main runners 66 that are suspended from the hook-shaped end portion 62 of the wire hangers 60. The main runners 66 have opposed first and second main runner ends 68, 69. The main runners 66 are supported on the first and second wall angles 30, 32 at their opposed first and second main runner ends 68, 69. The main runners 66 are substantially perpendicular to the joists 20. The ceiling tile support frame 64 also includes T-members 70 that are snapped into the main runners 66, and after being snapped in place the T-members 70 are substantially perpendicular to the main runners 66 and are secured in place. The T-members 70 provide for stability and strength, and together the main runners 66 and the T-members 70 make up the support frame 64 and are adapted to support ceiling tiles 72.

The main runners 66 are required to support a significant load and therefore have to be square and secured in place by the wire hangers 60 in order to accommodate the loads that will be imposed on them from, for example, the ceiling tiles 72 and their own weight. If the main runners 66 are not square, then when the ceiling tiles 72 are installed the main runners will sag and make the room 10 aesthetically unpleasing and the ceiling tiles 72 may be potentially unstable and or dangerous to people (not show) standing under the ceiling tiles 72.

Figure 5:
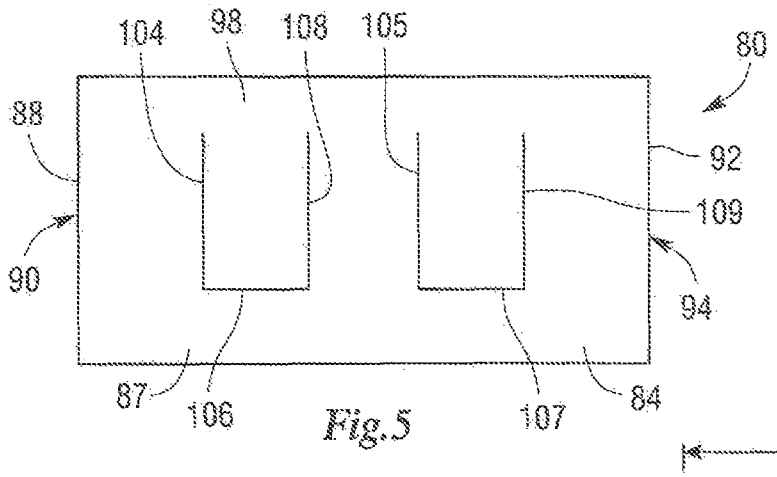
FIG. 5 is a front view of a housing having wherein cuts have been made for first and second support members and a cutting tab.
Figure 6:
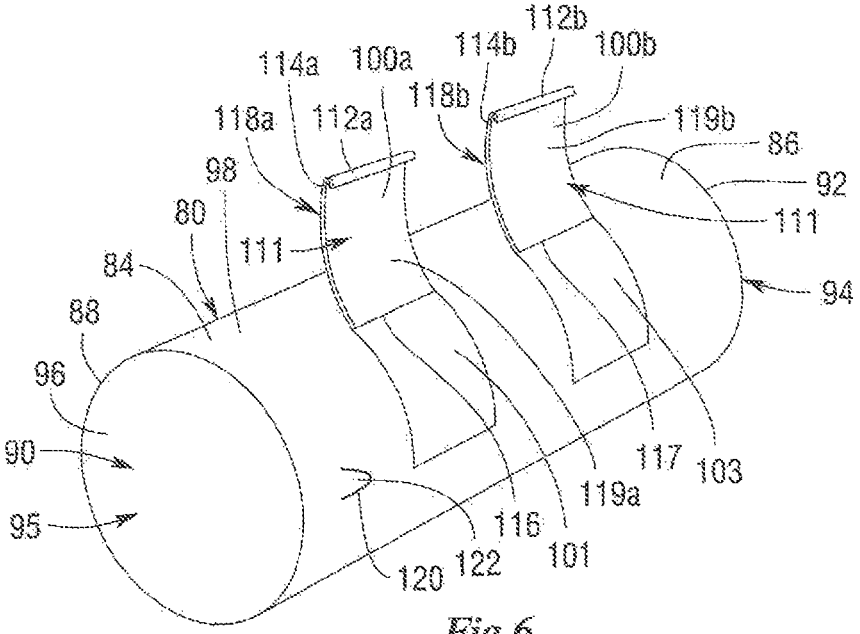
FIG. 6 is a front perspective view of the housing after the first and second support members and cutting tab have been pushed out.
Figure 7:
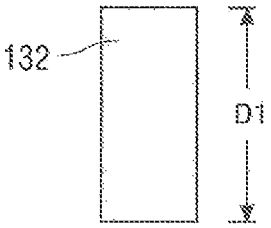
FIG. 7 is a front view of a feed cap.

To ensure the main runners 66 are square and are not sagging a string dispensing assembly 80 is provided as shown in FIGS. 1 and 5-13. The string dispensing assembly 80 includes a housing 84 as shown in FIGS. 5-7. The housing 84 has a cylindrical shape 86 (FIG. 6) in one of the embodiments. The housing 84 has a first housing end 88 that defines a first housing opening 90, and has an opposed second housing end 92 that defines a second housing opening 94. The first and second housing openings 90, 94 lead to a housing interior 95. The housing 84 also has opposed interior and exterior housing surfaces 96, 98. The housing 84 is made from metal in one of the embodiments, but also may be formed from plastic and other materials. The housing 84 is formed as a one-piece body 87 in one of the embodiments.

Figure 5A:
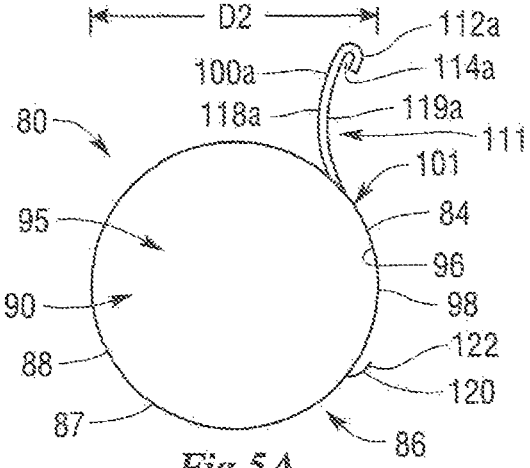
FIG. 5A is a left end view of the housing after first and second support members and cutting tab have been pushed out.

As shown in FIG. 6, the housing 84 has first and second support members 100*a*, 100*b* that extend outwardly from the exterior surface 98 of the housing 84, and the first and second support members 100*a*, 100*b* are the same shape and are structurally identical. In other embodiments may be differently shaped. As shown in FIG. 5, the first and second support members 100*a*, 100*b* are each formed by cutting the housing 84 three times to define first, second and third slits 104, 106, 108, respectively, and the housing 84 is cut three more times to define fourth, fifth, and sixth slits 105, 107, 109, respectively. The first, second and third slits 104, 106, 108, and fourth, fifth and sixth slits 105, 107, and 109 may be made by any suitable method, for example by slicing, sawing, laser cutting, stamping, and other methods well known to those having ordinary skill in the art. After the above described slits have been made, the first and second support members 100*a*, 100*b* are then pushed outwardly such that they extend beyond the exterior housing surface 98 of the housing 84 as shown in FIGS. 5A and 6. This can be accomplished mechanically at the point of manufacture and the techniques for pushing out pre-cut metal is well known to those having ordinary skill in the art. The first and second support members 100*a*, 100*b* are joined from the housing 84 along first and second bent portions 116, 117, respectively. The first and second support members 100*a*, 100*b* have a curved shape 111 as shown in FIGS. 5A and 6. After the first and second support members 100*a*, 100*b* have been pushed out, the housing 84 defines first and second dispenser openings 101, 103. In another embodiment there is only the first support member 100*a* and the second support member 100*b* is absent. In other embodiments there may be more than two support members, for example there may be support members 100*a*, 100*b* . . . 100*n*.

In addition, the first support member 100*a* has a first engagement tab 112*a*, and the second support member 100*b* has a second engagement tab 112*b*, respectively. The first and second engagement tabs 112*a*, 112*b* are created by folded a portion the first and second support members 100*a*, 100*b*. In other embodiments wherein the housing 84 is formed from plastic the first and second support members 100*a*, 100*b* and the first and second engagement tabs 112*a*, 112*b* are formed as part of the molding process of the housing 84.

The first support member 100*a* has opposed convex and concave surfaces 118*a*, 119*a* that extend to the first engagement tab 112*a*. The first engagement tab 112*a* is folded in on itself in such a way that the first engagement tab 112*a* faces the concave surface 119*a* of the first support member 100*a*. The first engagement tab 112*a* and the concave surface 119*a* of the first support member 100*a* that it faces define a first engagement slot 114*a*.

Similarly, the second support member 100*b* has opposed convex and concave surfaces 118*b*, 119*b* that extend to the second engagement tab 112*b*. The second engagement tab 112*b* is folded in on itself in such a way that the second engagement tab 112*b* faces the concave surface 119*b* of the second support member 100*b*. The second engagement tab 112*b* and the concave surface 119*b* of the second support member 100*b* that it faces define a second engagement slot 114*b*.

In addition, the housing 84 also has a cutting tab 120 having an edge 122, and the cutting tab 120 protrudes or extends outwardly from the exterior housing surface 98. As shown in FIG. 5 a cutting tab slit 110 was formed in housing 84 to define the cutting tab 120. The cutting tab 120 was pushed outward from the housing 84 in the same manner the first and second support members 100*a*, 100*b* were pushed out as described above. In other embodiments, there may be more than one cutting tab 120.

Figure 8:
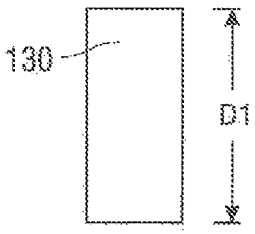
FIG. 8 is a front view of an end cap.
Figure 9:
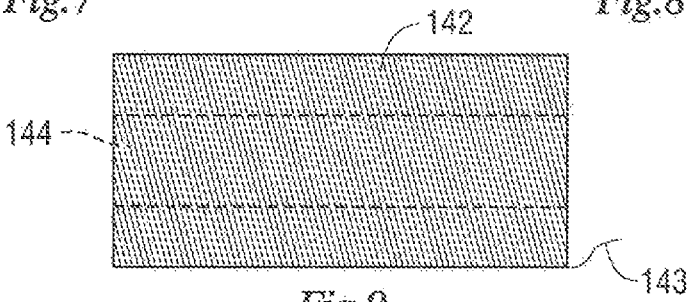
FIG. 9 is a front view of a string supply.
Figure 10:
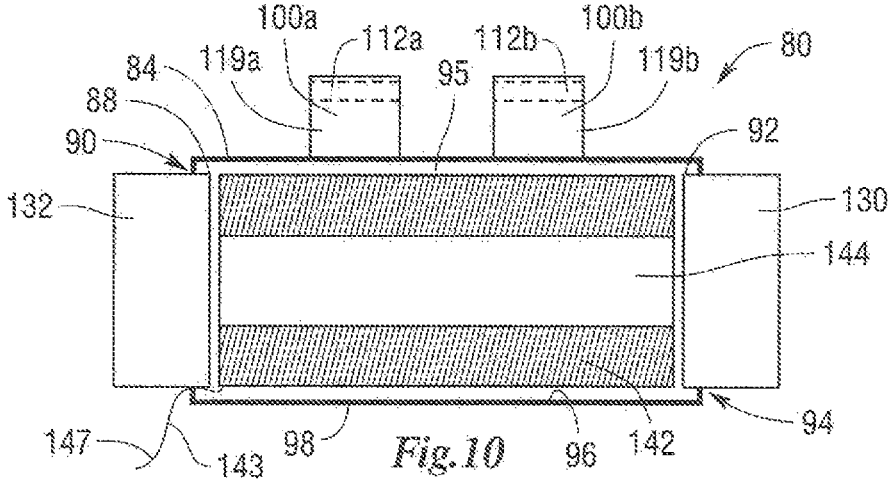
FIG. 10 is a sectional view of a string dispensing assembly.

As shown in FIGS. 7-9 the string dispensing assembly 80 further includes an end cap 130 and a feed cap 132. The feed cap 132 has a diameter designated D1 shown in FIG. 7 that is less than the diameter of the first housing opening 90 designated D2 in FIG. 5A, and the feed cap 132 can be fitted in the first housing opening 90 and held in place with a pressure or friction fit as shown in FIG. 10. The feed cap 132 can be made of rubber, silicone or a flexible resilient material such as a flexible resilient plastic or other suitable material. The end cap 130 also has a diameter designated D1 that is less than the diameter of the second housing opening 94, also designated D2, it being understood that the diameter of the first and second housing openings 90, 94 is the same in one of the embodiments. The end cap 130 can be fitted in the second housing opening 94 and held in place with a pressure or friction fit (FIG. 10). The end cap 130 is made plastic, wood, rubber, metal, silicone and can be made of the same material as the feed cap 132. It is pointed out that the feed cap 132 and end cap 130 can be manually installed or fitted in and manually removed from the housing 84.

Figure 11:
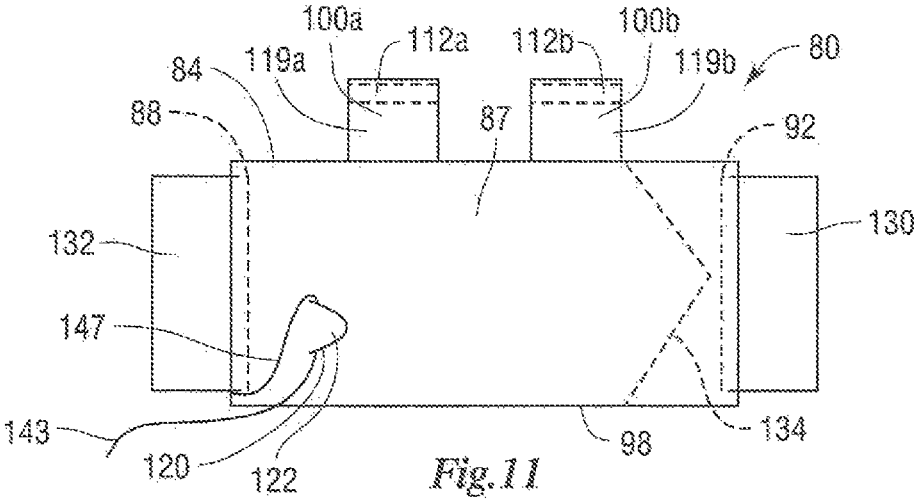
FIG. 11 is a front view of the string dispensing assembly.

As shown in FIGS. 10 and 11 the feed cap 132 and the end cap 130 are fitted in housing 84. The string dispensing assembly 80 also includes a string supply 142 from which extends a string 143 that was unwound from the string supply 142. The string supply 142 is disposed in the housing interior 95 and is positioned therein prior to the insertion of the feed cap 132 or the end cap 130 into the housing 84. In one embodiment the string supply 142 is in the form of string that is wound around a spool 144. In another embodiment the string supply 142 is in the form of string that is wound or coiled about itself and no spool 144 is present. It is noted that the string 143 is sometimes referred to as jet line to those having ordinary skill in the art. The string 143 that extends from the string supply 142 extends through the housing interior 95 and through the first housing opening 90, and the string 143 abuts against the feed cap 132 and interior housing surface 96. Due to the material from which the feed cap 132 is made, a user can controllably draw the string 143 from the housing interior 95 by pulling on the string 143. It is pointed out that there is tension on the string 143 as it is being drawn out of the housing interior 95 because of the string 143 being drawn is compressed by the feed cap 132 and interior housing surface 96 at all times. The user can draw out the desired amount of string 143 and then use the cutting edge 122 of the cutting tab 120 to cut the string 143 after the desired amount of string 143 has been pulled out of the housing 84. During the pulling process the string 143 that is internal to the housing 84 does not become tangled because there is no opportunity for that to happen because the string 143 is unwound in an orderly manner as it is being pulled out of the housing 84. As shown in FIG. 11, after the string 143 is cut by the cutting tab 120, there is an exposed portion 147 of the string 143 that extends from the feed cap 132 to the cutting tab 120. The exposed portion 147 of the string 143 is unable to retract back into the housing interior 95 because the string 143 is held in place due to being pressed by the feed cap 132 against the interior housing surface 96.

The housing 84 can be readily refilled with a fresh string supply 142 by removing end cap 130 or feed cap 132 and placing the string supply 142 in the housing 84, and then positioning the string 143 against the feed cap 132 and the interior housing surface 96, and positioning the exposed portion 147 of the string 143 that extends beyond the feed cap 132 such that the worker can readily grip the string 143 and pull more string 143 from the housing 84 as needed. Thus, the housing 84 can be reused.

In another embodiment the housing 84 has a tapered portion 134 that extends from the second housing end 92 as shown in dashed line in FIG. 11. The tapered portion 134 eliminates the need for the end cap 130. The sting supply 142 is inserted into the housing 80 through the first housing opening 90 in this embodiment and it contained therein by the feed cap 130 and the tapered portion 134 of the housing 84.

Figure 12:
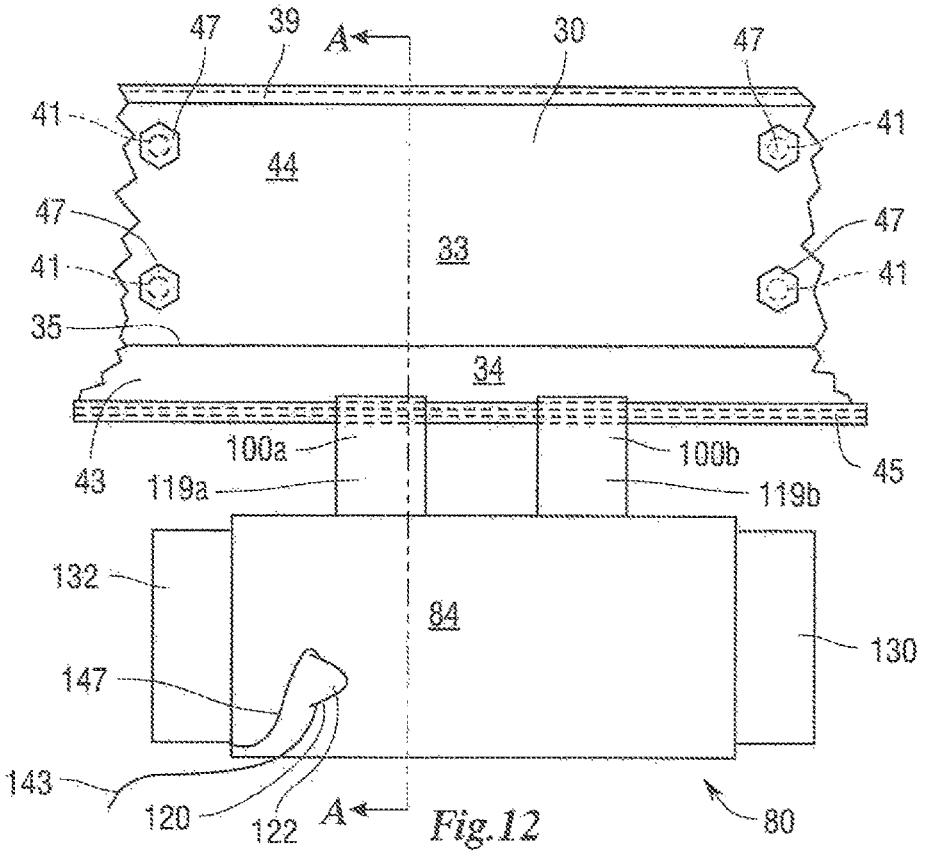
FIG. 12 is a front view of the string dispensing assembly supported on the first wall angle.
Figure 13:
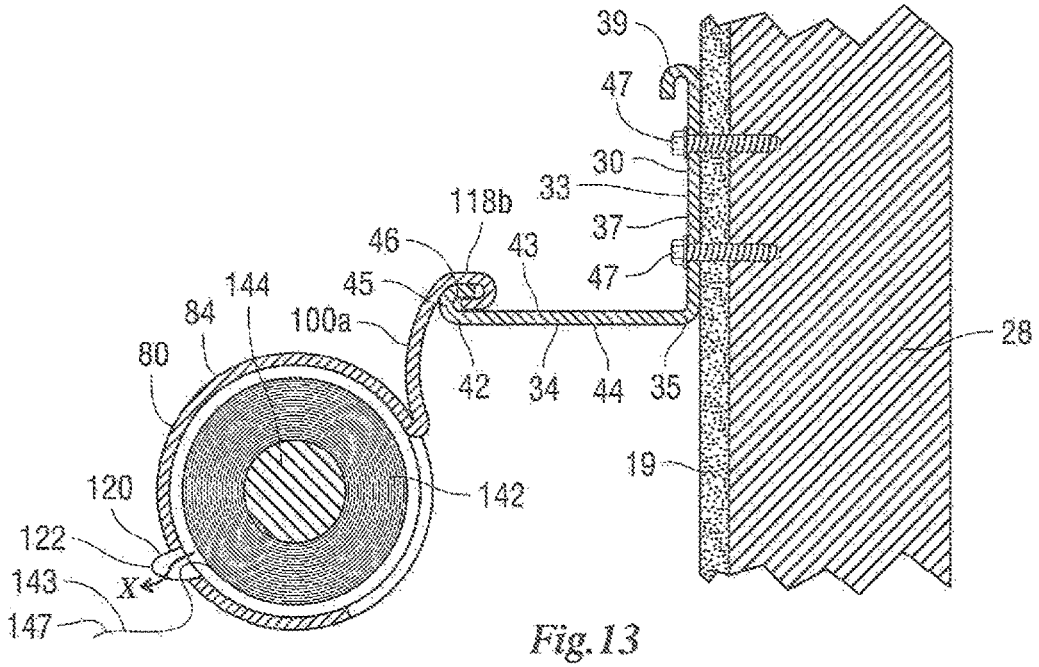
FIG. 13 is a sectional view of the string dispensing assembly taken along line A-A of FIG. 12.

In use, the string dispensing assembly 80 is installed on the first wall angle 30 as shown in FIGS. 1, 12 and 13. FIG. 13 is a sectional view taken along line A-A of FIG. 12 of the string dispensing assembly 80 when installed or hooked on the first wall angle 30. As shown, the string dispensing assembly 80 is disposed below the first wall angle 30. The first engagement tab 112*a* of the first support member 100*a* is fitted or slid in the main runner slot 46 that is defined by the main runner folded portion 45. Similarly, the second engagement tab 112*b* of the second support member 100*b* is fitted or slid in the main runner slot 46 that is defined by the main runner folded portion 45. When the first and second engagement tabs 112*a*, 112*b* are fitted in the main runner slot 46, the first and second support members 100*a*, 100*b* are thus securely supported by the first wall angle 30. In other words, the first and engagement tabs 112*a*, 112*b* of the first and second support members 100*a*, 100*b* and the main runner folded portion 45 are hooked together. The user (not shown) is then free to pull or draw string 143 from the housing 84 of the string dispensing assembly 80 in the manner described above (as indicated by the arrow designated X in FIG. 13). The string 143 offers some resistance to pulling because it pressed against the interior housing surface 96 and the feed cap 132. The user pulls the string 143 across the room 10 and ties the sting to the second wall angle 32, or the user can use a clamp 200 to pinch the sting 143 against the second wall angle 32 thus securing the string 143 in place. The string dispensing assembly 80 and the clamp 200 thus support the string 143 such that it is suspended and extends from the first wall angle 30 to the second wall angle 32.

At this point, the string 143 is taught and parallel or is substantially parallel to the floor 12 and perpendicular or substantially perpendicular to the first and second sidewalls 14, 16. The user can then visually compare the main runner 66 of the ceiling tile support frame 64 with the string 143 and determine if the main runner 66 is sagging. If the main runner 66 is sagging, the user or worker can re-bend the wire hangers 60 that support the main runner 66 until the main runner 66 is square, that is, until the main runner 66 and the string 143 are parallel. Thus, the main runner 66 is capable of being squared by use of the string dispensing assembly 80 with the string 143 serving as reference line.

After the main runner 66 is squared in the above-described manner, the user can slide the string dispensing assembly 80 along the first angle 30 to the next main runner 66 so the next main runner 66 can be squared. This may require the user to cut the string 143 because the user might not be able to slide the string dispensing assembly 80 along the first angle 30 past the next joist 20. So, if this happens, the user cuts the string 143 with the cutting tab 120 and moves the string dispensing assembly 80 past the next joist 20 and reinstalls or re-hooks the spring dispensing assembly 80 on the first wall angle 30 such that the string dispensing assembly 80 is next to the next main runner 66. The user repeats the above-described main runner 66 squaring process and levels the next main runner 66. Then, after squaring all the main runners 66 and after all the ceiling tiles 72 are installed, all the ceiling tiles 72 are level, that is, there is no sagging of the ceiling tiles 72 because all the main runners 66 that support them were leveled. After all the ceiling tiles 72 have been installed they form a room ceiling 76, and the room ceiling 76 does not have sagging ceiling tiles 72, because each of the ceiling tiles 72 is perpendicular to the first and second walls 14, 16 and horizontal relative to the floor 12. The entire above-described stringing process and squaring process can be done by one worker in a short amount of time.

Thus, the need for two workers to install ceiling tiles 72 so that they are level is eliminated, because the string dispensing assembly 80 eliminates the need for a second person to assist in the job of running string 143 for purposes of squaring main runners 66.

The housing 80 can be re-used after the sting supply 142 in the housing 80 has been used-up by removing the end cap 130 and refilling the housing 80 with a new string supply 142. In addition, the string dispensing assembly 80 may be sold with or without a sting supply 142 and the user can provide his or her own string supply 142.

It will be appreciated by those skilled in the art that while the string dispensing assembly 80 has been described in detail herein, the invention is not necessarily so limited and other examples, embodiments, uses, modifications, and departures from the embodiments, examples, uses, and modifications may be made without departing from the string dispensing assembly 80 and all such embodiments are intended to be within the scope and spirit of the appended claims.

What is claimed:

1. A method of squaring main runners used in construction of drop ceilings, the method comprising the steps of:

providing a room having opposed first and second sidewalls and connecting a first wall angle to the first sidewall and connecting a second wall angle to the second sidewall and providing the room with joists and supporting wire hangers from the joists and providing a main runner and supporting the main runner on the first and second wall angles and supporting the main runner from the wire hangers;

providing the first wall angle with a wall mounting portion and a main runner support portion and providing the main runner support portion with a main runner folded portion that extends to a main runner end and wherein the main runner folded portion defines a main runner slot;

providing a string dispensing assembly having a housing having a first housing end that defines a first housing opening, and having an opposed second housing end that defines a second housing opening and wherein the first and second housing openings lead to a housing interior, and the housing has opposed interior and exterior housing surfaces and disposing a string supply in the housing and wherein a string is capable of being drawn from the string supply;

providing the housing with a first support member that extends outwardly from the exterior housing surface along a first bent portion, and providing the first support member with opposed convex and concave surfaces that extend to a first engagement tab and folding the first engagement tab in such a way that the first engagement tab faces the concave surface of the first support member, and defining a first engagement slot with the first engagement tab and the concave surface of the first support member that faces thereto;

fitting the first engagement tab in the main runner slot such that the first engagement tab is hooked to the first wall angle such that the housing is supported by the first wall angle.

2. The method for squaring main runners according to claim 1 further including providing a second support member that extends outwardly from the exterior housing surface along a second bent portion, and providing the second support member with opposed convex and concave surfaces that extend to a second engagement tab, and folding the second engagement tab in such a way that the second engagement tab faces the concave surface of the second support member; and, wherein the second engagement tab and the concave surface of the second engagement tab that faces thereto define a second engagement slot; and, fitting the second engagement tab in the main runner slot such that the second engagement tab is hooked to the first wall angle such that the housing is supported by the first wall angle.

3. The method for squaring main runners according to claim 1 comprising the further acts of providing an end cap and a feed cap and wherein the end cap has a diameter that is less than a diameter of the second housing opening and fitting the end cap in the second housing opening and wherein the feed cap has a diameter that is less than a diameter of the first housing opening and fitting the feed cap in the first housing opening.

4. The method for squaring main runners according to claim 3 comprising the further act of constructing the feed cap from a flexible resilient material that includes at least the following: rubber, silicone; and flexible resilient plastic.

5. The method for squaring main runners according to claim 1 further comprising the steps of providing the housing with a cutting tab that extends outwardly from the exterior housing surface and the cutting tab is for cutting the string.

6. The method for squaring main runners according to claim 5 further wherein the string extends from the string supply extends from the string supply and abuts against a feed cap and abuts the interior housing surface such that the string is configured to be manually pulled out of the housing without retracting back into the housing after being pulled out of the housing and cutting the string with the cutting tab.

7. The method for squaring main runners according to claim 6 including the further step of drawing the string from the housing and securing the string to the second wall angle such that the string is perpendicular to the first and second sidewalls and adjusting the wire hangers until the main runner is parallel to the string.

8. The method for squaring main runners according to claim 7 further including the step of cutting the string and removing the housing from the first wall angle and hooking the housing to the first wall angle near the next main runner and drawing the string from the housing and securing the string to the second wall angle such that the string is perpendicular to the first and second sidewalls and adjusting the wire hangers until the next main runner is parallel to the string.

* * * * *